US005839992A

United States Patent [19]

Phillips

[11] Patent Number: 5,839,992

[45] **Date of Patent: *Nov. 24, 1998**

[54] RESILIENT WRIST SUPPORT AND THERAPEUTIC HAND EXERCISER

[75] Inventor: Lester Phillips, Houston, Tex.

[73] Assignee: Gayla Industries, Inc., Houston, Tex.

[ * ] Notice: The term of this patent shall not extend beyond the expiration date of Pat. No. 5,718,655.

[21] Appl. No.: 911,295

[22] Filed: Aug. 14, 1997

Related U.S. Application Data

[63] Continuation-in-part of Ser. No. 678,660, Jul. 11, 1996, Pat. No. 5,718,655.

[51] Int. Cl.[6] ..... A63B 23/16

[52] U.S. Cl. ..... 482/49

[58] Field of Search ..... 482/44, 49, 22, 482/50, 20, 148; 273/58 F, 58 H; 446/267, 369

[56] References Cited

U.S. PATENT DOCUMENTS

| | | | |
|---|---|---|---|
| 4,952,190 | 8/1990 | Tarnoff et al. | 446/267 |
| 5,158,255 | 10/1992 | Fuller | 248/118 |
| 5,228,655 | 7/1993 | Garcia et al. | 248/118 |
| 5,350,342 | 9/1994 | Scatterday | 482/49 |
| 5,445,349 | 8/1995 | Hart | 248/118 |
| 5,566,913 | 10/1996 | Prokop | 248/118 |
| 5,718,655 | 7/1996 | Phillips | 482/49 |

*Primary Examiner*—Stephen R. Crow
*Attorney, Agent, or Firm*—Kenneth A. Roddy

[57] ABSTRACT

A resilient wrist support and therapeutic hand exerciser device for supporting the wrist of a person performing repetitive tasks with their wrist, hand and fingers, such as using a computer mouse and typing on a keyboard, and for exercising the muscles of the wrist, hand, fingers and forearm of the user. A mass of tiny glass spheres having the consistency and appearance of a fine powder is enclosed in a resilient inner bladder surrounded by a resilient outer bladder and a thin layer of powder is disposed between the exterior surface of the inner bladder and interior surface of the outer bladder to prevent theme from sticking together, reduce friction therebetween, and allow relative sliding movement between the surfaces. The tiny spheres provide low resistance to relative particle movement by rolling on each other upon an increase or decrease in pressure applied to the device. When placed on a flat surface beneath the wrist of a user, the device deforms slightly and conforms to the underside of the user's wrist to form a comfortable cradle-like support as the downward pressure of the wrist increases or decreases. As the wrist is moved relative to the flat surface, the device smoothly rolls between the wrist and the flat surface to provide a smooth massaging effect on the wrist while maintaining wrist support. The resilient device can be squeezed in the palm of the hand to exercise the muscles of the hand, fingers, wrist, and forearm.

5 Claims, 2 Drawing Sheets

14
12A
14

10

17
13
12
14
11A
11
12B
11B
17

RESILIENT WRIST SUPPORT AND THERAPEUTIC HAND EXERCISER

CROSS-REFERENCE TO RELATED APPLICATION

This application is a Continuation-In-Part of U.S. patent application Ser. No. 08/678,660 filed Jul. 11, 1996, now U.S. Pat. No. 5,718,655.

BACKGROUND OF THE INVENTION

1. Field of the Invention

This invention relates generally to devices for supporting the wrist of a person performing repetitive tasks with their wrist, hand and fingers, such as using a computer mouse and typing on a keyboard, and resilient therapeutic hand exercisers, and more particularly to a resilient wrist support and therapeutic hand exerciser which contains a mass of tiny glass spheres having the consistency and appearance of a fine powder enclosed in a resilient double ply bladder with a thin layer of powder disposed between the plies of the bladders.

2. Brief Description of the Prior Art

Wrist support devices for supporting the wrist of a person performing repetitive tasks with their wrist, hand and fingers, such as using a computer mouse and typing on a keyboard are known in the art.

There are several commercially available wrist support devices which consist of a pad formed of neoprene or homogeneous foam rubber that may be attached to a computer mouse or keyboard. These types of wrist supports are relatively stiff and non-compliant to the user's wrist. Other wrist support devices are known which utilize an outer covering or bladder filled with a gel, or with seed, grain, or other "granular" or crystalized particles which have flat surfaces and/or sharp points.

Garcia et al, U.S. Pat. No. 5,228,655 discloses a wrist rest support which includes a base pad that is positioned partially under the keyboard or mouse and a section extending away therefrom that has a top surface for supporting the wrists. In one embodiment the device has detachable foam riser sections which can be substituted to change the height of the wrist supporting section.

Prokop, U.S. Pat. No. 5,566,913 discloses a wrist rest apparatus which includes an elastic envelope filled with a gelatinous material that supports the wrist and may also be heated or cooled to provide additional therapeutic effects. In some embodiments, the Hart device can be grasped with both hands and squeezed to function as an exercise means.

Hart, U.S. Pat. No. 5,445,349 discloses a wrist support system which includes an elongate cloth container and particulate material such as rice disposed within the interior of a tubular-shaped segment. The device provides a stable support for the wrist and gently massages the wrist during finger movement, and may also be heated or cooled to provide additional therapeutic effects.

Fuller, U.S. Pat. No. 5,158,255 discloses a generally cylindrical wrist rest apparatus which includes a tubular solid rigid core that cannot bend surrounded by a yieldable foam layer having an irregular exterior and a soft fabric outer covering. The device provides a support for the wrist and can also be grasped and squeezed to function as an exercise means.

Therapeutic hand exercisers are also known in the art. There are several commercially available resilient hand exercisers which fit into the palm of the hand.

A resilient rubber hand exerciser known as the "Eggserciser" (TM) is sold by Eggstra Enterprises, Inc., of Alabaster, Ala. This device is an egg-shaped member molded of homogeneous foam rubber.

Other hand exercisers are known which utilize a single or double layer resilient outer covering or bladder filled with sand, seed, grain, or other "granular" or crystalized particles which have flat surfaces and/or sharp points. However, the sharp surfaces or points of the "granular" or crystalized filler material will abrade the interior surface of the resilient bladder and cause premature wear resulting in short product life, and leakage of the filler material.

A pliable hand exerciser sold by Qualatex of Wichita, Kans. under the name "Ad Impressions" (TM) ASI 78200 is a natural latex balloon filled with hard granular particles having the consistency of sand. The neck of the balloon is tied in a knot. This device has only a single layer of natural latex and the filler material particles are irregular shaped many faceted particles with flat surfaces and sharp edges and range in particle size from about 1/32" to about 3/64". The Qualatex device is firm and hard, has a "crunching" feel when squeezed, has very poor resiliency, and substantially retains a distorted shape after being squeezed.

Therapeutic hand exercisers known as the "Gripp" (™) and "Thera-Gripp" (™) are sold by Abilitations of Atlanta Ga. These devices resemble a small ball in their natural state and are filled with a material which appears to be yellow seeds or grain, similar to wheat or oats, permanently encased in two layers of natural latex. The filler material particles are oval-shaped with two flat sides, approx. 3/32" in length and 1/32" thick. These devices are relatively firm and hard, have a "crunching" feel when squeezed, and have poor resiliency.

Scatterday, U.S. Pat. No. 5,350,342 discloses a deformable semi-resilient grip having a filler material which includes a mixture of lubricating powder and particles surrounded by a bladder consisting of a single thick layer, a thin layer surrounded by a thick layer, or a number of thin layers wherein the layers are fixed together.

Tarnoff, U.S. Pat. No. 4,952,190 discloses a deformable novelty toy having a single layer bladder containing a cohesive mixture of low-density microspheres and a small amount of liquid, such as water, mineral oils, glycols, etc., in an amount effective to unite the microspheres and provide cohesion and moldability. Thus, the filler material mixture has a high resistance to relative movement such that the article is capable of absorbing impact energy by deformation, rather than being resilient.

Prior art wrist support devices which utilize a filler material of irregular shaped particles having facets or flat surfaces are uncomfortable to the wrist, are relatively hard, and do not provide a smooth rolling action during wrist movement. If they also function as an exerciser when squeezed, they produce a "crunching" action due to the relative movement between the irregular shaped particle surfaces as they are compressed and displaced and this type of filler material makes them harder to squeeze, or more resistant to squeezing. Whether functioning as a wrist support or exerciser, these types of devices tend to hold their distorted shape for a period of time until the resiliency of the bladder forces the irregular shaped particles to move relative to one another as the device slowly resumes its natural shape. Thus, they are relatively non-resiliently responsive and tend to be only pliable, rather than resilient.

The present invention is distinguished over the prior art in general, and these patents in particular, by a resilient wrist support and therapeutic hand exerciser containing a mass of tiny glass spheres having the consistency and appearance of a fine powder enclosed in a resilient inner bladder surrounded by an outer resilient bladder with a thin layer of powder disposed between the exterior surface of the inner bladder and interior surface of the outer bladder to prevent the surfaces from sticking together and allow relative sliding movement between the layers. This feature prevents wear or friction between the plys and extends the life of the product. The double ply bladder gives the product resiliency, flexibility, compressibility, and strength without excessive wall thickness.

Unlike irregular-shaped particle fillers, the tiny spheres roll on each other upon a pressure force being applied and removed and thus provide low resistance to relative movement of the particles. This feature produces a soft comfortable surface for supporting the wrist and a smooth rolling action during wrist movement. When used as an exerciser, this feature allows the device to be compressed quickly and to resume its natural shape quickly and thus provides a quicker resilient response.

Also, unlike prior art wrist supports and therapeutic hand exercisers filled with sand, seed, grain, or other "granular" or crystalized material which have flat surfaces and/or sharp points, the powder-like tiny glass spheres used in the present invention have no flat surfaces or sharp points. Thus, the filler material is substantially nonabrasive and significantly reduces or eliminates the problem of the filler material abrading the resilient bladder material, and also extends the life of the product.

SUMMARY OF THE INVENTION

It is therefore an object of the present invention to provide a resilient wrist support and therapeutic hand exerciser which comfortably supports the wrist of a person performing repetitive tasks with their wrist, hand and fingers, such as using a computer mouse and typing on a keyboard.

It is another object of this invention to provide a resilient wrist support device which can be placed adjacent to a computer mouse or keyboard for supporting the wrist of the user and can also be squeezed in the palm of the hand for use as a therapeutic resilient hand exerciser.

Another object of this invention is to provide a resilient wrist support and therapeutic hand exerciser having a double wall bladder of resilient material with a talc powder layer between the double plies of resilient material to provide resiliency, flexibility, compressibility, and strength without excessive wall thickness.

Another object of this invention is to provide a resilient wrist support and therapeutic hand exerciser having a double wall bladder of resilient material with a talc powder layer between the double plies of resilient material to prevent the double plies of material from sticking together and allow the plies of resilient material to slide relative to one another when the device is compressed, thus reducing wear and friction between the plies and extending the life of the product.

A further object of this invention is to provide a resilient wrist support and therapeutic hand exerciser having a resilient bladder filled with tiny glass spheres having the consistency of a fine powder wherein the tiny spheres roll on each other as the device is squeezed and the pressure is released and thereby providing low resistance to relative movement of the filler material and allowing the device to be compressed quickly and to resume its natural shape quickly.

A still further object of this invention is to provide a resilient wrist support and therapeutic hand exerciser having a resilient bladder filled with tiny glass spheres having the consistency of a fine powder wherein the tiny spheres have no flat surfaces or sharp edges which would abrade the interior surface, and will significantly reduce or eliminate the problem of the filler material abrading the resilient bladder material, and significantly extend the life of the product.

Other objects of the invention will become apparent from time to time throughout the specification and claims as hereinafter related.

The above noted objects and other objects of the invention are accomplished by a resilient wrist support and therapeutic hand exerciser device for supporting the wrist of a person performing repetitive tasks with their wrist, hand and fingers, such as using a computer mouse and typing on a keyboard, and for exercising the muscles of the wrist, hand, fingers and forearm of the user. A mass of tiny glass spheres having the consistency and appearance of a fine powder is enclosed in a resilient inner bladder surrounded by a resilient outer bladder and a thin layer of powder is disposed between the exterior surface of the inner bladder and interior surface of the outer bladder to prevent theme from sticking together, reduce friction therebetween, and allow relative sliding movement between the surfaces. The tiny spheres provide low resistance to relative particle movement by rolling on each other upon an increase or decrease in pressure applied to the device. When placed on a flat surface beneath the wrist of a user, the device deforms slightly and conforms to the underside of the user's wrist to form a comfortable cradle-like support as the downward pressure of the wrist increases or decreases. As the wrist is moved relative to the flat surface, the device smoothly rolls between the wrist and the flat surface to provide a smooth massaging effect on the wrist while maintaining wrist support. The resilient device can be squeezed in the palm of the hand to exercise the muscles of the hand, fingers, wrist, and forearm.

DESCRIPTION OF THE PREFERRED EMBODIMENT

Figures 1, 2:
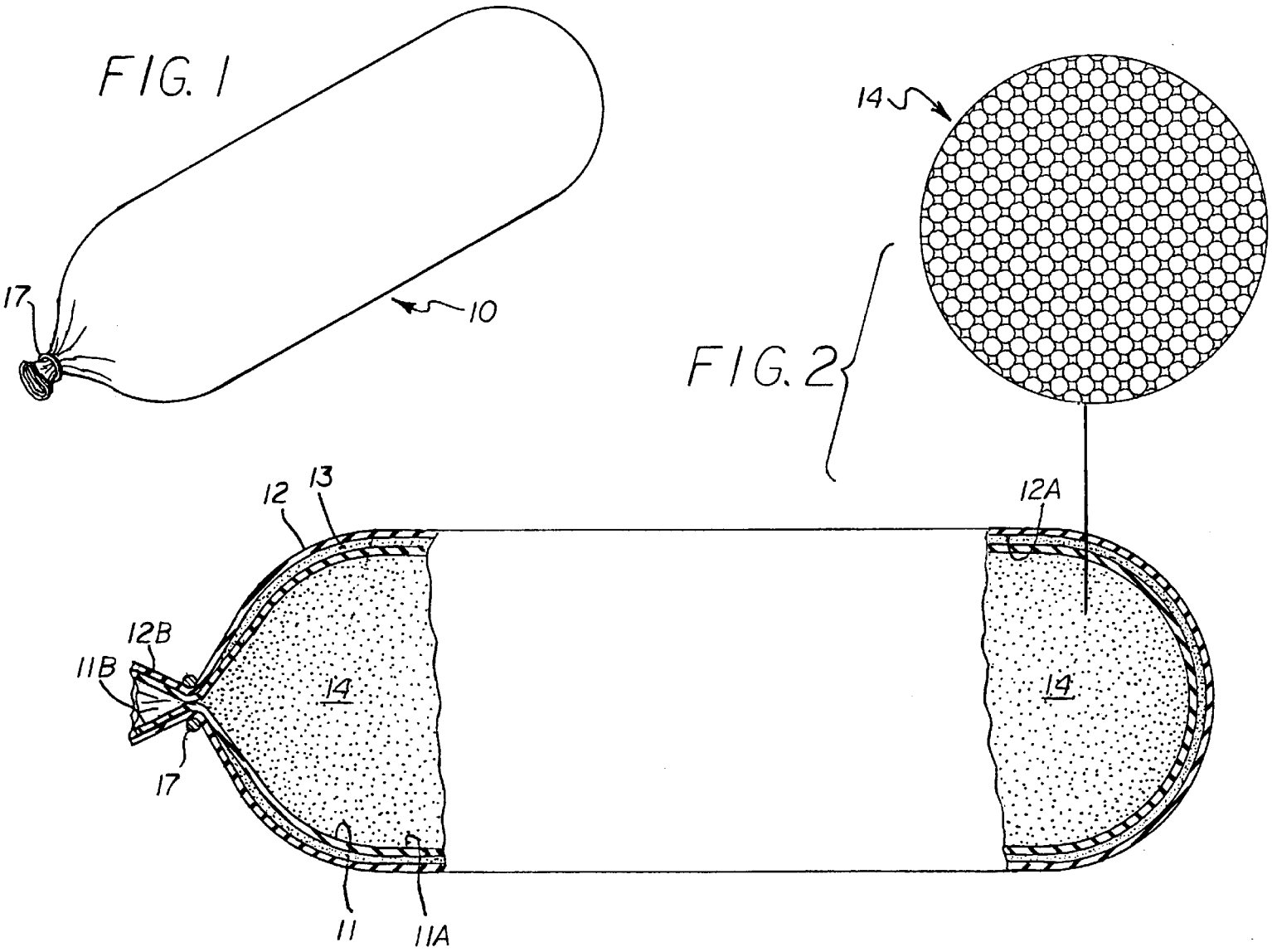
FIG. 1 is a perspective view of the resilient wrist support and therapeutic hand exerciser in accordance with the present invention.
FIG. 2 is a partial cross section view of the resilient wrist support and therapeutic hand exerciser.

Referring to the drawings by numerals of reference, there is shown in FIGS. 1 and 2, a preferred resilient wrist support and therapeutic hand exerciser 10 in accordance with the present invention. In its natural state, as shown in FIG. 1, the device 10 is a generally cylindrical-shaped member approximately 2¼ in diameter and approximately 6" in length.

FIG. 2 shows the device 10 in cross section at a slightly larger scale. As seen in FIG. 2, the exerciser 10 is formed of an inner bladder 11 and an outer bladder 12 formed of resilient material such as latex rubber. Each bladder 11 and 12 has a main body portion 11A and 12A and a tubular neck portion 11B and 12B, respectively.

The inner and outer bladders 11 and 12 are superposed to provide a double layer of resilient material. A thin layer or coating of talc powder 13 is disposed between the exterior of the main body portion 11A and the interior of the main body portion 12A, to prevent friction or sticking between the superposed layers and allow relative movement therebetween.

The interior of the inner resilient bladder 11 is filled with a powder-like material 14 formed of tiny glass spheres having a particle size ranging from about 70 to about 140 mesh (U.S. standard), which equates to a particle diameter of from about 0.0083" to about 0.0041". The filler material 14 is represented schematically in the drawing figure. In reality, the filler material has the consistency and appearance of a fine white powder. The tiny glass sphere material 14 has a density of about 98 lbs/ft$^3$. The tiny glass spheres are formed of soda-lime glass, or glass oxide. A suitable glass sphere material is manufactured by Potters Industries Inc., of Carlstadt, N.J. and known commercially as "Impact Beads".

Figure 3:
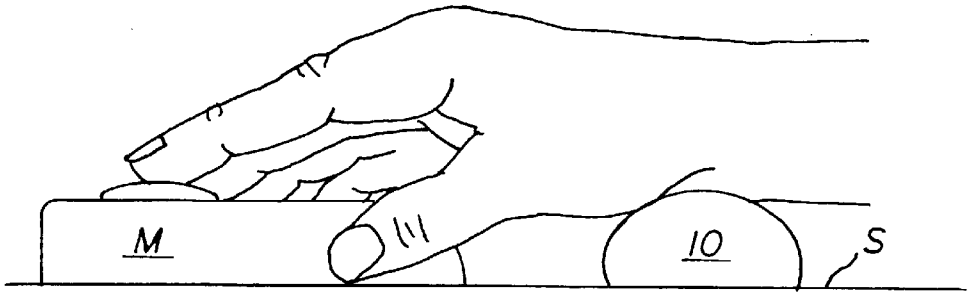
FIG. 3 is a side elevation showing the resilient wrist support and therapeutic hand exerciser being used to support the wrist of a person using a computer mouse.
Figure 4:
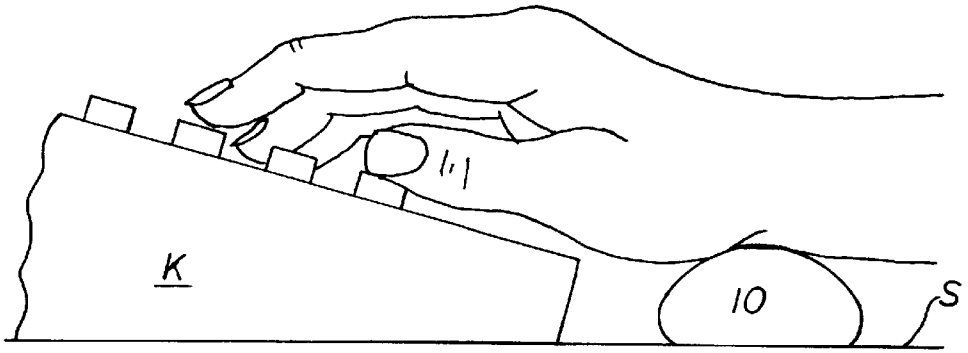
FIG. 4 is a side elevation showing the resilient wrist support and therapeutic hand exerciser being used to support the wrist of a person using a keyboard.

As shown in FIGS. 3 and 4, when used as a wrist support, the device 10 is placed onto a flat surface S adjacent to a computer mouse M or keyboard K. The user then places the underside of their wrist on the top surface of the device. The user may reposition the device to so as to provide a comfortable support for the wrist while using the mouse or keyboard. The weight of the user's wrist causes the device to deform slightly such that the underside of the device flattens against the flat surface S and its top side conforms to the shape of the underside of the wrist and thereby forms a comfortable supporting cradle for the wrist.

As the downward pressure of the wrist increases or decreases, the tiny glass spheres of the powder-like filler material 14 roll on each other and the resiliency of the double bladder allows the device to maintain engagement with the wrist and conform the cradle to the downward pressure. As the wrist is moved over the flat surface S, the device 10 rolls between the wrist and the flat surface, and the tiny glass spheres of the powder-like filler material 14 roll on each other to allow the device to maintain the cradle-like supporting engagement with the underside of the wrist. This feature also provides the device with a smooth rolling action during wrist movement. The wrist of the user also receives a soft massaging effect as the device 10 rolls between the wrist and the flat surface. When the user's wrist is removed from the device 10, the device quickly resumes its natural shape due to the contraction of the resilient double ply bladder and the relative rolling action of the tiny glass spheres of the powder-like filler material 14.

Figure 5:
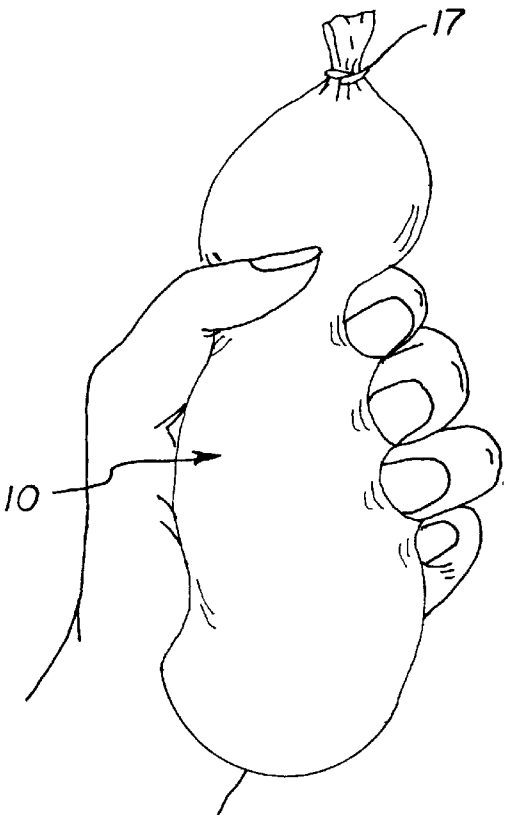
FIG. 5 is a perspective view of the resilient wrist support and therapeutic hand exerciser being held in the palm of a hand and used as an exerciser.

As shown in FIG. 5, the device 10 may also be used as a therapeutic hand exerciser. The device 10 is placed in the palm area of the hand and is squeezed and released for exercise and therapy of the muscles of the wrist, hand, fingers, and forearm. The device 10 provides a smooth resistance to the squeezing pressure.

The double bladders 11 and 12 provide a resilient double ply exterior wall which gives the device resiliency, flexibility, compressibility, and strength without excessive wall thickness. The layer of talc powder 13 between the double ply walls prevents the plies of resilient material from sticking together and allows the plies to slide relative to one another when the device is squeezed and released. This feature prevents wear or friction between the walls and extends the life of the product.

The tiny glass spheres of the powder-like filler material 14 roll on each other as the device is squeezed and the pressure is released. This feature allows the device to be compressed quickly and to resume its natural shape quickly when the resiliency of the double wall bladder forces the device to resume its natural shape.

The combination of the resilient double ply wall with the talc powder layer between the double ply walls and the powder-like tiny glass spheres which roll on each other as the device is squeezed and released give the present invention a unique smooth squishy feeling when squeezed and released, and makes it more resiliently responsive than prior art hand exercisers filled with sand, seed, grain, or other "granular" or crystalized material which have flat surfaces and/or sharp points.

METHOD OF MANUFACTURE

The method of manufacturing the resilient wrist support and therapeutic hand exerciser 10 is described in my previous U.S. Patent No., titled "Therapeutic Hand Exerciser and Method Of Manufacture", issued on, which is hereby incorporated herein by reference. However, a brief overview of the manufacturing method will be discussed for a more complete understanding of how the present device is manufactured.

The bladders 11 and 12 are elongate balloon-like members formed of rubber, preferably latex. During the manufacture of the bladders 11 and 12, a talc powder coating is applied to their interior and exterior surfaces to prevent the rubber surfaces from sticking together. The neck portion 11B of the first, or inner resilient bladder 11 having a talc powder coating on its interior and exterior surfaces is installed on the open bottom end of a funnel or hopper and biasly retained thereon by its resiliency.

A rod or dowel is inserted through the interior of the funnel or hopper and into the first, or inner, resilient bladder 11 to push its bottom end downwardly and stretch the first resilient bladder longitudinally so that it becomes narrower than the interior diameter of the neck portion 12B of the second or outer bladder 12. The second or outer resilient bladder 12 having a talc powder coating on its interior and exterior surfaces is installed over the longitudinally extended first or inner resilient bladder 11 in superposed relation with its neck portion 12B surrounding and biasly engaged on the neck portion 11B of the first resilient bladder 11. After the outer bladder 12 is installed, the rod or dowel is withdrawn.

The superposed inner and outer resilient bladders 11 and 12 are then laterally pressed to drive air out of the space between the exterior of the inner resilient bladder and the interior of outer resilient bladder.

After being pressed, a volume of air is temporarily introduced into the interior of the inner resilient bladder 11 to inflate and temporarily expand the superposed body portions 11A and 12A of the inner and outer resilient bladders 11 and 12 as a unit.

The interior of the inner resilient bladder 11 is then filled with a volume of the previously described tiny glass sphere material 14 having the consistency of fine powder to slightly expand the superposed body portions 11A and 12A of the inner and outer resilient bladders 11 and 12.

The superposed inner and outer resilient bladders 11 and 12 filled with the powder-like tiny glass sphere material 14 is then passed through a heat tunnel and subjected to hot air to radially shrink the superposed layers around the mass of powder-like tiny glass sphere material 14, and remove air from the powder-like mass and from between the superposed layers of resilient material.

The superposed neck portions 11A and 12A of the inner and outer resilient bladders 11 and 12 are removed from the bottom end of the funnel or hopper, and inserted into a pneumatic stapling machine. The stapling machine is actuated to secure a wire staple 17 transversely around the superposed neck portions 11B and 12B to seal the open end of the bladders. The wire staple 17 does not penetrate the resilient material, but is crimped around the neck portions 11B and 12B in the manner of a sausage staple on a sausage casing. The sealed device is then cleaned and dried to remove any powder-like tiny glass spheres from the exterior thereof.

While this invention has been described fully and completely with special emphasis upon a preferred embodiment, it should be understood that within the scope of the appended claims the invention may be practiced otherwise than as specifically described herein.

I claim:

1. A resilient wrist support and therapeutic hand exerciser device for supporting the wrist of a person performing repetitive tasks with their wrist, hand and fingers, such as using a computer mouse and typing on a keyboard, and for exercising the muscles of the wrist, hand, fingers and forearm of the user, the device comprising:

an inner bladder formed of resilient material;

an outer bladder formed of resilient material superposed on said inner bladder;

a thin layer of powder disposed between an exterior surface of said inner bladder and an interior surface of said outer bladder to prevent said surfaces from sticking together, to reduce friction therebetween, and allow relative sliding movement between said inner and outer bladder surfaces; and a mass of tiny spheres contained within said inner bladder having a particle size of from about 70 to about 140 U.S. standard mesh (about 0.0083" dia. to about 0.0041" dia.) and having the consistency and appearance of fine powder, said tiny spheres providing low resistance to relative particle movement by rolling on each other upon an increase or decrease in pressure applied to said device; wherein when placed on a flat surface beneath the wrist of a user, the weight of the user's wrist causes said device to deform slightly such that the underside of the device flattens against the flat surface and its top side engages and conforms to the shape of the underside of the wrist to form a comfortable cradle-like support; and as the downward pressure of the wrist increases or decreases, said tiny spheres roll on each other and the resiliency of said bladders allows said device to maintain said cradle-like conforming engagement with the wrist, and as the wrist is moved relative to the flat surface, said tiny spheres roll on each other to allow said device to smoothly roll between the wrist and the flat surface and provide a smooth massaging effect on the wrist while maintaining said cradle-like supporting engagement therewith; and when held in the palm of the user's hand and subjected to an alternating squeezing and releasing action, the resiliency of said bladders and said tiny spheres rolling on each other allow said device to be compressed and to resume its natural shape smoothly and quickly to exercise the muscles of the hand, fingers, wrist, and forearm of the user.

2. The device according to claim 1, wherein said mass of tiny spheres has a density of about 98 lbs/ft$^3$.

3. The device according to claim 1, wherein said tiny spheres are glass spheres formed of glass oxide (soda-lime glass).

4. The device according to claim 1, wherein said inner and outer bladders are formed of latex.

5. The device according to claim 1, wherein said inner and outer bladders have an elongate tubular main body portion and superposed neck portions extending upwardly therefrom; and a fastener element crimped around said neck portions to securely seal said mass of tiny spheres within said bladders.

* * * * *